US011751291B2

(12) United States Patent
Kanagawa et al.

(10) Patent No.: US 11,751,291 B2
(45) Date of Patent: Sep. 5, 2023

(54) INDUCTION HEATING APPARATUS

(71) Applicant: Samsung Electronics Co., Ltd., Suwon-si (KR)

(72) Inventors: Tomoyuki Kanagawa, Yokohama (JP); Masaki Ono, Yokohama (JP); Masashi Sasagawa, Yokohama (JP); Masayuki Otawara, Yokohama (JP); Nobuhara Nishikoori, Yokohama (JP); Taro Yoshida, Yokohama (JP); Yutaka Yagi, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 205 days.

(21) Appl. No.: 17/150,458

(22) Filed: Jan. 15, 2021

(65) Prior Publication Data

US 2021/0219390 A1 Jul. 15, 2021

(30) Foreign Application Priority Data

Jan. 15, 2020 (JP) ..... 2020-004143
Dec. 15, 2020 (KR) ..... 10-2020-0175150

(51) Int. Cl.
*H05B 6/04* (2006.01)
*H05B 6/06* (2006.01)

(52) U.S. Cl.
CPC ..... *H05B 6/04* (2013.01); *H05B 6/062* (2013.01)

(58) Field of Classification Search
CPC ..... H05B 6/062; H05B 6/04
See application file for complete search history.

(56) References Cited

U.S. PATENT DOCUMENTS 6,812,440 B2 11/2004 Hirota et al.
2004/0188426 A1* 9/2004 Hirota ..... H05B 6/04 219/622
2021/0160971 A1* 5/2021 Yung ..... H02J 50/12

FOREIGN PATENT DOCUMENTS

JP H0536472 A 2/1993
JP 2982364 B2 11/1999
JP 2001-332375 A 11/2001
JP 2007-335274 A 12/2007
JP 2008-300113 A 12/2008
(Continued)

OTHER PUBLICATIONS

International Search Report dated May 4, 2021, issued in International Application No. PCT/KR2021/000150.

*Primary Examiner* — Dana Ross
*Assistant Examiner* — Kuangyue Chen
(74) *Attorney, Agent, or Firm* — Jefferson IP Law, LLP

(57) ABSTRACT

An induction heating apparatus is provided. The induction heating apparatus includes a heating coil, an inverter, a current sensor configured to measure a driving current supplied from the inverter to the heating coil, and a controller configured to provide a drive signal to the inverter to allow the driving current to follow a target current based on a user input. The controller reduces a driving duty of the drive signal based on the driving current exceeding a predetermined reference current, and the controller provides a drive signal to the inverter to allow the driving current to follow a current less than the target current, based on the driving current being less than or equal to the predetermined reference current after reducing the driving duty of the drive signal.

13 Claims, 11 Drawing Sheets

(56) References Cited

FOREIGN PATENT DOCUMENTS

| | | | | |
|---|---|---|---|---|
| JP | 2009110922 | A | * | 5/2009 |
| JP | 4289002 | B2 | | 7/2009 |
| JP | 2009-272241 | A | | 11/2009 |
| JP | 4800345 | B2 | | 10/2011 |
| JP | 5355350 | B2 | * | 11/2013 |
| JP | 5355350 | B2 | | 11/2013 |
| JP | 2014-146531 | A | | 8/2014 |
| JP | 2019-153423 | A | | 9/2019 |
| JP | 2019153423 | A | * | 9/2019 |
| KR | 10-2012-0109965 | A | | 10/2012 |

* cited by examiner

CASE IN WHICH OUTPUT CURRENT OF INVERTER EXCEEDS PREDETERMINED VALUE (28A)

CASE IN WHICH DIFFERENCE BETWEEN COIL CURRENT AND INVERTER OUTPUT CURRENT IS LESS THAN PREDETERMINED VALUE

CASE IN WHICH DIFFERENCE BETWEEN COIL CURRENT AND INVERTER OUTPUT CURRENT IS LESS THAN PREDETERMINED VALUE

INDUCTION HEATING APPARATUS

CROSS-REFERENCE TO RELATED APPLICATION(S)

This application is based on and claims priority under 35 U.S.C. § 119(a) of a Korean patent application number 10-2020-0175150, filed on Dec. 15, 2020, in the Korean Intellectual Property Office, and of Japanese patent application number 2020-004143, filed on Jan. 15, 2020, in the Japanese Patent Office, the disclosure of each of which are incorporated by reference herein in their entireties.

BACKGROUND

1. Field

The disclosure relates to an induction heating apparatus using a heating coil.

2. Description of Related Art

According to Japanese Patent Application Laid-Open No. 2001-332375, which discloses an induction heating cooking device according to the related art, a heating coil and a resonant capacitor supplied with power from an inverter are connected in series, and this LC series resonance heats a pot in the induction heating method.

When a non-magnetic material pot formed of a non-magnetic material such as aluminum is heated by the induction heating cooking device, the pot shakes while floating or being pushed out of position. Pot-floating (a phenomenon in which the pot shakes and floats with respect to the heating coil) is caused by a magnetic force, which is generated in the non-magnetic pot and is repulsive to the heating coil. The magnetic force is generated by an eddy current having a reverse phase in the non-magnetic pot and the eddy current is generated by a current flowing through the heating coil during the heating. The force causing the pot-floating of a non-magnetic pot increases as a current of the heating coil increases. On the other hand, in a pot formed of a magnetic material such as iron, a repulsive force does not occur due to the flow of an eddy current perpendicular to the current direction of the heating coil, and thus the pot-floating does not occur.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an induction heating cooking device capable of using an LC parallel resonant circuit rather than an LC series resonant circuit according to the related art.

In a state in which a non-magnetic pot is heated in the induction heating method by an induction heating cooking device using the LC parallel resonant circuit, a resonance frequency is lowered as shown in FIG. 7A in response to pot-floating or plot-displacement. As a result, impedance rapidly decreases at a driving frequency (about 75 kilohertz (kHz)) of an inverter circuit, and thus an inverter current rapidly increases. In response to the lowered impedance and the increased current, heat generation of a device including components of the inverter circuit increases, and the device is broken.

In addition, in a state in which a non-magnetic pot is heated in the induction heating method by an induction heating cooking device using the LC series resonant circuit, a resonance frequency is lowered as shown in FIG. 7B in response to the pot-floating or the plot-displacement. However, because impedance increases at a driving frequency (about 75 kHz) of an inverter circuit, an inverter current decreases. Therefore, heat generation of a device does not occur.

Another aspect of the disclosure is to provide an induction heating cooking device capable of determining pot-floating (a phenomenon in which a pot shakes and floats with respect to a heating coil) or pot-displacement (a phenomenon in which a pot shakes and is displaced or moved and thus is out of a position with respect to a heating coil) while suppressing an inverter current.

Additional aspects will be set forth in part in the description which follows and, in part, will be apparent from the description, or may be learned by practice of the presented embodiments.

In accordance with an aspect of the disclosure, an induction heating apparatus is provided. The induction heating apparatus includes a heating coil, an inverter, a current sensor configured to measure a driving current supplied from the inverter to the heating coil, and a controller configured to provide a drive signal to the inverter to allow the driving current to follow a target current based on a user input. The controller reduces a driving duty of the drive signal based on the driving current exceeding a predetermined reference current, and the controller provides a drive signal to the inverter to allow the driving current to follow a current less than the target current, based on the driving current being less than or equal to the predetermined reference current after reducing the driving duty of the drive signal.

The controller may identify pot-floating, in which a pot floats with respect to a heating coil, based on the driving current being less than or equal to the predetermined reference current after reducing the driving duty of the drive signal.

The controller may stop an operation of the inverter based on the driving current exceeding the predetermined reference current after reducing the driving duty of the drive signal.

The controller may identify pot-displacement, in which a pot is out of a position with respect to the heating coil, based on the driving current exceeding the predetermined reference current after reducing the driving duty of the drive signal.

The controller may reduce the driving duty of the driving signal by a predetermined amount of reduction in each carrier cycle based on the driving current exceeding the predetermined reference current.

The controller may reduce a driving frequency of the driving signal by a predetermined amount of reduction in each carrier cycle based on the driving current exceeding the predetermined reference current.

The induction heating apparatus may further include a resonant capacitor connected in parallel with at least a portion of the heating coil.

The induction heating apparatus may further include a resonant capacitor connected in series with the heating coil, and a resonant inductor connected in parallel with the heating coil and the resonant capacitor.

The induction heating apparatus may further include a first resonant capacitor connected in series with the heating coil, a second resonant capacitor connected in parallel with the heating coil and the first resonant capacitor, and a resonant inductor connected in series with the heating coil, the first resonant capacitor and the second resonant capacitor.

In accordance with another aspect of the disclosure, a control method of an induction heating apparatus including a heating coil and an inverter is provided. The control method includes measuring a driving current supplied from the inverter to the heating coil, providing a drive signal to the inverter to allow the driving current to follow a target current based on a user input, reducing a driving duty of the drive signal based on the driving current exceeding a predetermined reference current, and providing a drive signal to the inverter to allow the driving current to follow a current less than the target current, based on the driving current being less than or equal to the predetermined reference current after reducing the driving duty of the drive signal.

The control method may, further include identifying pot-floating, in which a pot floats with respect to a heating coil, based on the driving current being less than or equal to the predetermined reference current after reducing the driving duty of the drive signal.

The control method may further include stopping an operation of the inverter based on the driving current exceeding the predetermined reference current after reducing the driving duty of the drive signal.

The control method may further include identifying pot-displacement, in which a pot is out of a position with respect to the heating coil, based on the driving current exceeding the predetermined reference current after reducing the driving duty of the drive signal.

The reduction of the driving duty of the drive signal may include reducing the driving duty of the drive signal by the predetermined amount of reduction in each carrier cycle based on the driving current exceeding a predetermined reference current.

The reduction of the driving duty of the drive signal may include reducing a driving frequency of the driving signal by a predetermined amount of reduction in each carrier cycle based on the driving current exceeding the predetermined reference current.

In accordance with another aspect of the disclosure, an induction heating apparatus is provided. The induction heating apparatus includes a heating coil, an inverter, a first current sensor configured to measure an output current output from the inverter, a second current sensor configured to measure an input current input to the heating coil, and a controller configured to provide a drive signal to the inverter to allow at least one of the output current and the input current to follow a target current based on a user input. The controller reduces a driving duty of the drive signal based on that a difference between the output current and the input current being less than or equal to a predetermined reference value, and the controller provides a drive signal to the inverter to allow the driving current to follow a current less than the target current, based on the difference between the output current and the input current exceeding the predetermined reference value.

The controller may identify pot-floating, in which a pot shakes and floats with respect to a heating coil, based on that the difference between the output current and the input current exceeds the predetermined reference value after reducing the driving duty of the drive signal.

The controller may stop an operation of the inverter based on the difference between the output current and the input current being less than or equal to the predetermined reference value after reducing the driving duty of the drive signal.

The controller may identify pot-displacement, in which a pot shakes with respect to a heating coil and is out of a position with respect to the heating coil, based on the difference between the output current and the input current being less than or equal to the predetermined reference value after reducing the driving duty of the drive signal.

The controller may reduce a driving frequency of the driving signal based on the difference between the output current and the input current being less than or equal to the predetermined reference value.

In accordance with another aspect of the disclosure, a method performed by an induction heating cooking device is provided. The method includes initiating a heating operation of the induction heating cooking device based on an input; identifying whether a magnetic or non-magnetic pot is provided on the induction heating cooking device during the heating operation; in a case that a non-magnetic pot is provided on the induction heating cooking device, identifying a position of the non-magnetic pot with respect to a heating coil of the induction heating cooking device; in a case that the non-magnetic pot is out of position with respect to a heating coil, modifying at least one parameter of an inverter circuit driving the heating coil.

The identifying of the position of the non-magnetic pot with respect to the heating coil of the induction heating cooking device further includes identifying whether the non-magnetic pot is floating or displaced with respect to the heating coil.

The method further includes performing a first operation based on identifying that the non-magnetic pot is floating with respect to the heating coil; and performing a second operation, different from the first operation, based on identifying that the non-magnetic pot is displaced with respect to the heating coil.

The at least one parameter of the inverter circuit includes a driving frequency or a driving duty cycle.

Other aspects, advantages, and salient features of the disclosure will become apparent to those skilled in the art from the following detailed description, Which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
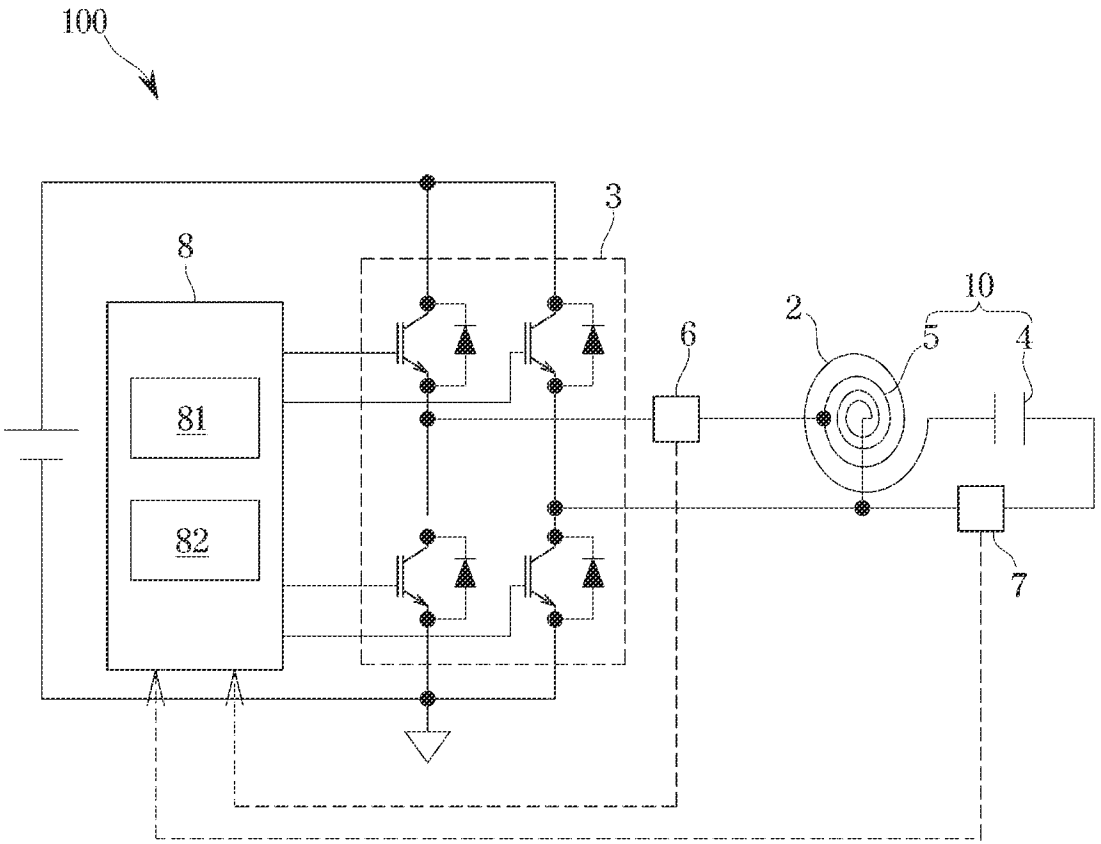
FIG. 1 is a schematic diagram illustrating an overall configuration of an induction heating cooking device according to an embodiment of the disclosure.

The following description with reference to the accompanying drawings is provided to assist in a comprehensive understanding of the various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Additionally, various embodiments will now be described more fully hereinafter with reference to the accompanying drawings. The various embodiments may, however, be embodied in many different forms and should not be construed as being limited to the embodiments set forth herein. These embodiments are provided so that this disclosure will be thorough and complete and will fully convey the various embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the various embodiments of the disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Hereinafter an induction heating cooking device according to embodiments of the disclosure will be described in detail with reference to the accompanying drawings.

FIG. 1 is a schematic diagram illustrating an overall configuration of an induction heating cooking device according to an embodiment of the disclosure.

Referring to FIG. 1, an induction heating cooking device 100 is configured to heat a cooking pot (including a pan) formed of a magnetic material, such as iron or a cooking pot (including a pan) formed of a non-magnetic material, such as aluminum by using an induction heating method.

Particularly, the induction heating cooking device 100 includes a heating coil 2 configured to heat an object to be heated using an induction heating method, an inverter circuit 3 configured to supply a high frequency current to the heating coil 2, an LC parallel resonant circuit 10 including a resonant capacitor 4 connected in series with the heating coil 2 and a resonance coil element 5 connected in parallel to the resonant capacitor 4, an inverter current detector 6 configured to detect an output current of the inverter circuit 3, a coil current detector 7 configured to detect a coil current flowing the heating coil 2, and a control device 8 configured to control the inverter circuit 3. In an embodiment, the control device 8 may include an inverter circuit controller 81 and a determiner 82.

The heating coil 2 is provided under a top plate on which a cooking pot is placed, and the heating coil 2 heats the cooking pot through the top plate using the induction heating method.

The inverter circuit 3 may convert a voltage supplied from the commercial power source into a high frequency and supply the high frequency current to the heating coil. The inverter circuit 3 may be a full bridge method using a semiconductor switching device.

The resonant coil element 5 is composed of a part of the heating coil 2.

The inverter current detector 6 is provided on an output side of the inverter circuit 3, and particularly, is provided between the inverter circuit 3 and the heating coil 2. A detection signal (output current) of the inverter current detector 6 may be transmitted to the control device 8.

The coil current detector 7 is provided in the LC parallel resonant circuit 10. A detection signal (coil current) of the coil current detector 7 may be transmitted to the control device 8.

Figure 2A:
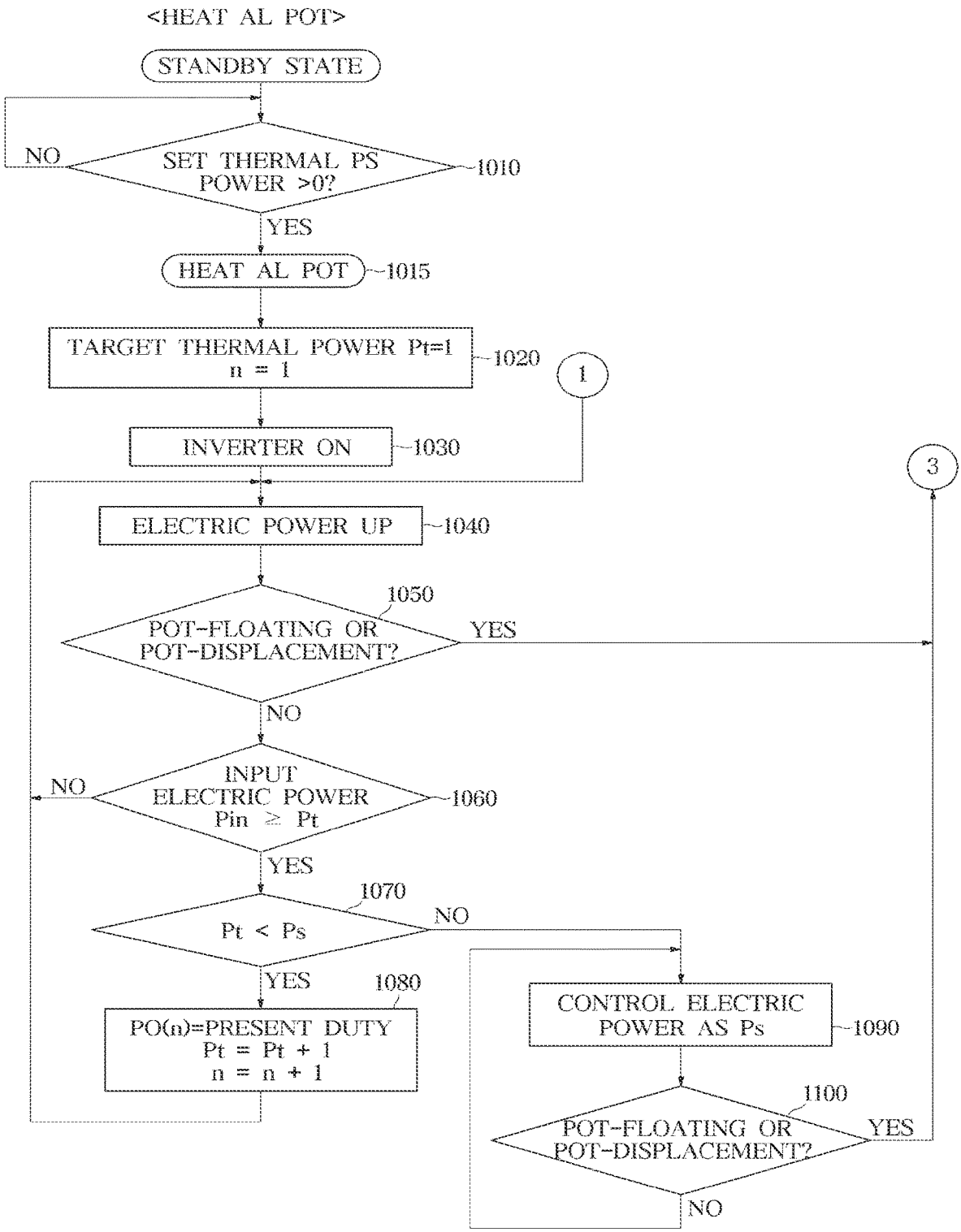
FIG. 2A is a flow chart illustrating an example of control of a control device according to an embodiment of the disclosure.
Figure 2B:
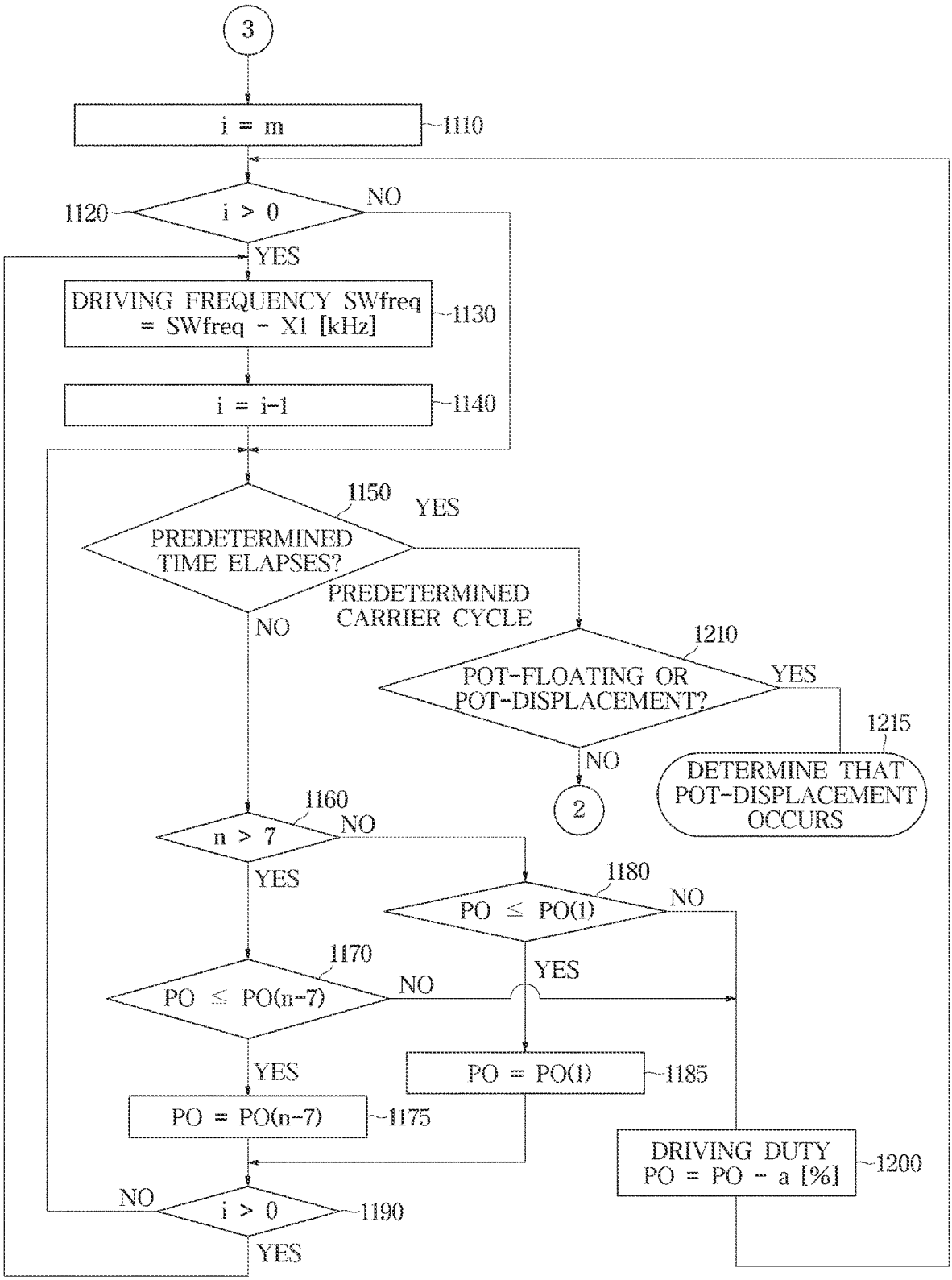
FIG. 2B is a flow chart illustrating the example of control of the control device according to an embodiment of the disclosure.
Figure 3:
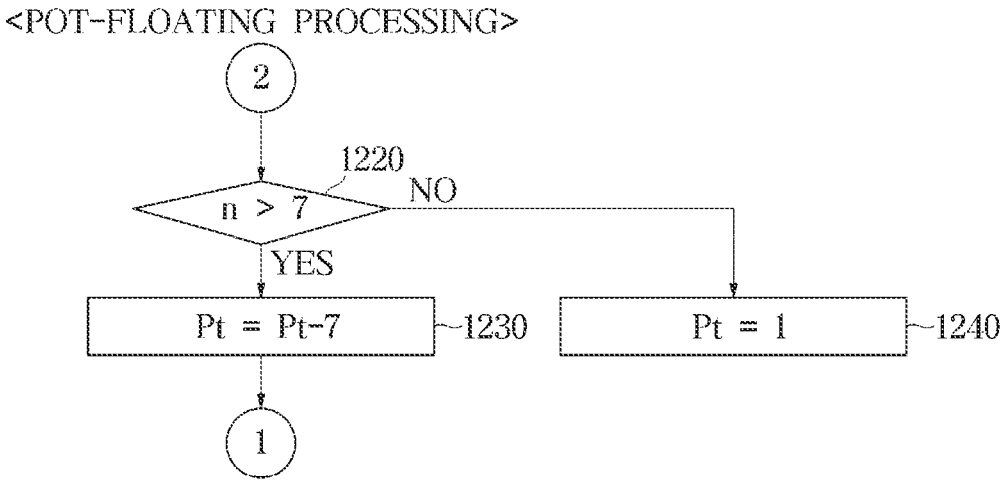
FIG. 3 is a flow chart illustrating a process of pot floating of the control device according to an embodiment of the disclosure.

The control device 8 may control the inverter circuit 3 to heat the cooking pot with a desired thermal power, as shown in the flowcharts (an example of a control form) shown in FIGS. 2A, 2B and 3.

FIG. 2A is a flow chart illustrating an example of control of a control device according to an embodiment of the disclosure.

FIG. 2B is a flow chart illustrating the example of control of the control device according to an embodiment of the disclosure.

FIG. 3 is a flow chart illustrating a process of pot floating of the control device according to an embodiment of the disclosure.

Referring to FIGS. 2A, 2B and 3, the control device 8 may control the inverter circuit 3 to heat a non-magnetic pot formed of a non-magnetic material such as aluminum (AL).

The control device 8 identifies whether or not a set thermal power Ps input (provided by a user) is greater than "0" in a standby state at operation 1010.

In response to the set thermal power Ps input being less than or equal to "0" (No in 1010), the control device 8 may maintain the standby state.

In response to the set thermal power Ps being greater than "0" (Yes in operation 1010), the control device 8 may convert the state into a state of heating a pot at operation 1015.

The control device 8 sets target thermal power Pt, which indicates target power supplied to the heating coil 2 from the inverter circuit 3, to "1", and sets a thermal power index n, which indicates an increase in the thermal power to reach the set thermal power, to "1" at operation 1020.

The control device 8 turns on the inverter circuit 3 at operation 1030.

The control device 8 controls the inverter circuit 3 to increase the electric power provided to the heating coil 2 at operation 1040. The control device 8 may provide a drive signal to the inverter circuit 3.

The control device 8 identifies whether pot-floating or pot-displacement occurs at operation 1050.

In response to the pot-floating or the pot-displacement not being identified (No in operation 1050), the control device 8 identifies whether or not input electric power Pin input to the heating coil 2 is equal to or greater than the target thermal power Pt at operation 1060.

In response to the input electric power Pin being less than the target thermal power Pt (No in operation 1060), the control device 8 controls the inverter circuit 3 to increase the electric power supplied to the heating coil 2 at operation 1040.

In response to the input electric power Pin being equal to or greater than the target thermal power Pt (Yes in operation 1060), the control device 8 identifies whether or not the target thermal power Pt is less than the set thermal power Ps at operation 1070.

In response to the target thermal power Pt being less than the set thermal power Ps (Yes in operation 1070, the control device 8 records a driving duty as an output PO (n), which indicates output thermal power of the induction heating cooking device 100 (or a driving duty of the inverter circuit), and the control device 8 increases the target thermal power Pt by "1", and increases the thermal power index n by "1" at operation 1080. Sequentially, the control device 8 controls the inverter circuit 3 to increase the electric power supplied to the heating coil 2 at operation 1040.

In response to the target thermal power Pt being equal to or greater than the set thermal power Ps (No in operation 1070), the control device 8 constantly controls the electric power as the set thermal power Ps at operation 1090.

During controlling the electric power as the set thermal power Ps, the control device 8 identifies whether or not the pot-floating or the pot-displacement occurs at operation 1100.

In response to the pot-floating or the pot-displacement not being identified (No in operation 1100), the control device 8 constantly controls the electric power as the set thermal power Ps at operation 1090.

In response to the pot-floating or the pot-displacement being identified in the operation 1050 or 1100 (Yes in operation 1050 or yes in operation 1100), the control device 8 records a predetermined value (m) as a parameter reduction index (i) at operation 1110. The parameter reduction index i indicates an amount of reduction of a driving parameter including a driving frequency and a driving duty cycle of the inverter circuit 3, and the predetermined value m is greater than "2" and may be changed by a designer, a user, or a manufacturer of the induction heating cooking device 100.

Thereafter, the control device 8 identifies whether the parameter reduction index i is greater than "0" at operation 1120.

In response to the duty reduction index i being greater than "0" (Yes in operation 1120), the control device 8 reduces the driving frequency SWfreq of the inverter circuit 3 to SWfreq-X1 at operation 1130. "X1" indicates an amount of reduction in the driving frequency, and may be set experimentally or empirically.

Thereafter, the control device 8 reduces the duty reduction index i by "1" at operation 1140.

Thereafter, the control device 8 identifies whether a predetermined time elapses after reducing the driving frequency SWfreq of the inverter circuit 3 at operation 1150.

In response to the predetermined time not elapsing (No in operation 1150), the control device 8 identifies whether the thermal power index n is greater than 7 at operation 1160. In other words, the control device 8 may identify whether or not the set thermal power level is greater than level 7.

In response to the thermal power index n being greater than 7 (Yes in operation 1160), the control device 8 identifies whether the output PO of the heating cooking device 100 is less than or equal to output PO (n−7) that is 7 levels lower than the thermal power level at operation 1170.

In response to the output PO of the heating cooking device 100 being greater the output PO (n−7) that is 7 levels lower than the thermal power level (No in 1170), the control device 8 reduces the output PO, which indicates the driving duty of the inverter circuit 3, to output PO-a at operation 1200. It is noted that "a" indicates an amount of reduction in the driving duty of the inverter circuit 3, and may be set experimentally or empirically. Thereafter, the control device 8 identifies whether the parameter reduction index i is greater than "0" at operation 1120.

In response to the output PO of the heating cooking device 100 being less than or equal to the output PO (n−7) that is 7 levels lower than the thermal power level (Yes in operation 1170), the control device 8 sets the output PO to the output PO (n−7) that is 7 levels lower than the thermal power level at operation 1175. Thereafter, the control device 8 identifies whether the parameter reduction index i is greater than "0" at operation 1190.

In response to the thermal power index n being less than or equal to 7 (No in operation 1160), the control device 8 identifies whether the output PO of the heating cooking device 100 is less than or equal to an output of the thermal power level 1 PO (1) at operation 1180.

In response to the output PO being greater than the output of the thermal power level 1 PO (1) (No in operation 1180), the control device 8 reduces the output PO, which indicates the driving duty of the inverter circuit 3, to an output PO-a at operation 1200. "a" indicates an amount of reduction in the driving duty of the inverter circuit 3, and may be set experimentally or empirically. Thereafter, the control device 8 identifies whether the parameter reduction index i is greater than "0" at operation 1120.

In response to the output PO being less than or equal to the output of the thermal power level 1 PO (1) (Yes in operation 1180, the control device 8 sets the output PO to the output of the thermal power level 1 PO (1) at operation 1185. Thereafter, the control device 8 identifies whether the parameter reduction index i is greater than "0" at operation 1190.

In response to a predetermined time elapsing (Yes in operation 1150), the control device 8 identifies whether pot-floating or pot-displacement occurs at operation 1210.

In response to the pot-floating or the pot-displacement not being identified (No in operation 1210), the control device 8 identifies whether the thermal power index n is greater than 7 at operation 1220. In other words, the control device 8 may identify whether or not the set thermal power level is greater than level 7.

In response to the thermal power index n being greater than 7 (Yes in operation 1220), the control device 8 sets the target thermal power Pt of the heating cooking device 100 to target thermal power Pt−7 that is 7 levels lower than the target thermal power level at operation 1230. Thereafter, the control device 8 controls the inverter circuit 3 to increase the electric power supplied to the heating coil 2 at operation 1040.

In response to the thermal power index n being less than or equal to 7 (No in operation 1220), the control device 8 sets the target thermal power Pt of the heating cooking device 100 to "1" at operation 1240. Thereafter, the control device 8 controls the inverter circuit 3 to increase the electric power supplied to the heating coil 2 at operation 1040.

In response to the pot-floating or the pot-displacement being identified in the operation 1210 (Yes in operation 1210), the control device 8 identifies the pot-displacement at operation 1215.

As mentioned above, the control device 8 sets the target current based on the target thermal power (set value) input from a user, and controls the inverter circuit 3 to allow the current output from the inverter circuit 3 to follow the target current. Particularly, the control device 8 includes an inverter circuit controller 81 and a determiner 82.

The inverter circuit controller 81 controls the inverter circuit 3 based on target thermal power (set value) input from a user. Particularly, the inverter circuit controller 81 outputs a control signal to the inverter circuit 3 according to the target thermal power input from the user, and controls the output current and coil current output from the inverter circuit 3.

The determiner 82 determines whether "pot-floating" occurs or whether "pot-displacement" occurs by using an output current (IINV [A]) detected by the inverter current detector 6 and a coil current (ICOIL [A]) detected by the coil current detector 7.

Figure 4A:
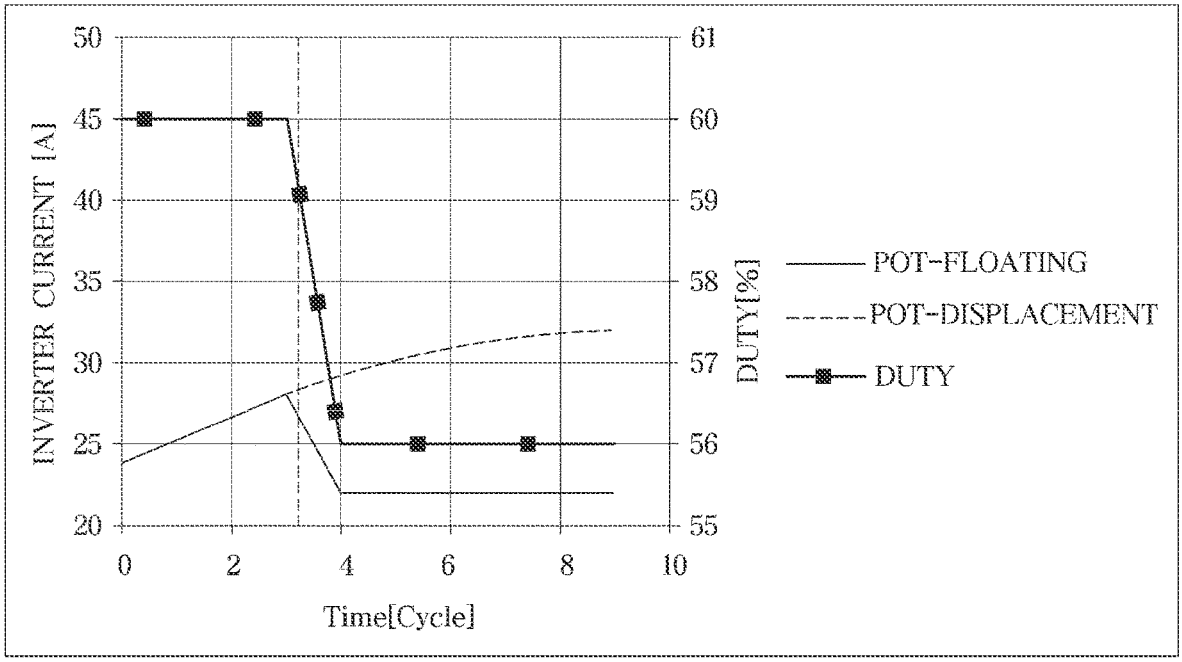
FIG. 4A is a diagram illustrating changes in an output current of an inverter and a coil current in response to "pot-floating" or "pot-displacement" according to an embodiment of the disclosure.
Figure 4B:
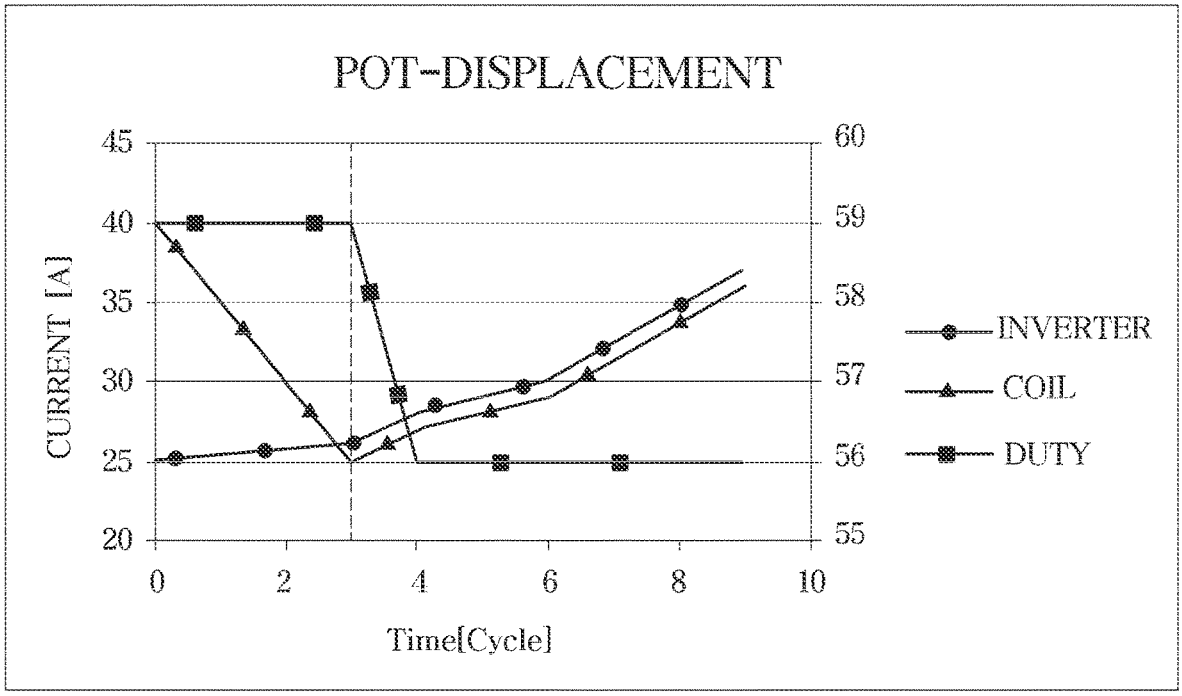
FIG. 4B is a diagram illustrating changes in the output current of the inverter and the coil current in response to "pot-displacement" according to an embodiment of the disclosure.
Figure 4C:
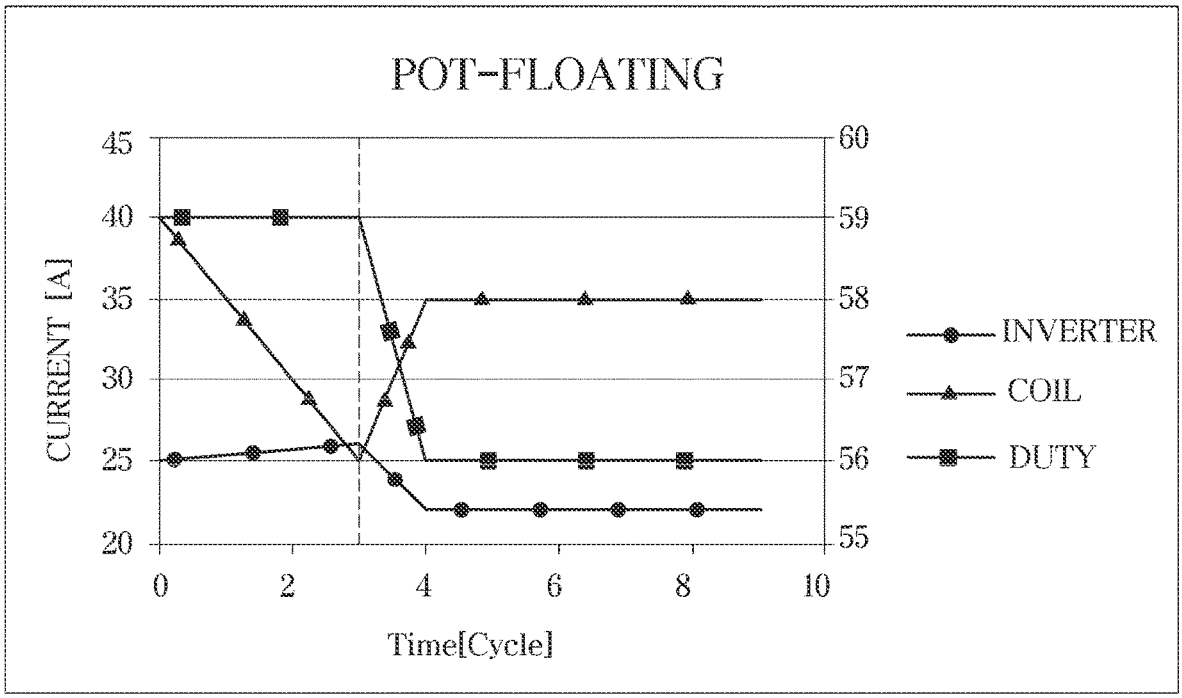
FIG. 4C is a diagram illustrating changes in the output current of the inverter and the coil current in response to "pot-floating" according to an embodiment of the disclosure.

FIG. 4A illustrates changes in an output current of an inverter and a coil current in response to "pot-floating" or "pot-displacement" according to an embodiment of the disclosure. FIG. 4B is a diagram illustrating changes in the output current of the inverter and the coil current in response to "pot-displacement" according to an embodiment of the disclosure. FIG. 4C is a diagram illustrating changes in the output current of the inverter and the coil current in response to "pot-floating" according to an embodiment of the disclosure.

Referring to FIG. 4A, when the driving duty of the inverter circuit 3 changes from 60% to 56% in a state in which an inverter current exceeds a predetermined value 28A, in response to "pot-floating", the inverter current may decrease. In contrast, in response to "pot-displacement", the inverter current may increase gradually without decreasing. In other words, in response to "pot-floating", when the driving duty of the inverter circuit 3 is reduced in the state in which the inverter current exceeds the predetermined value 28A, the inverter current may decrease. Further, in response to "pot-displacement", when the driving duty of the inverter circuit 3 is reduced in the state in which the inverter current exceeds the predetermined value 28A, the inverter current may still increase.

Referring to FIG. 4B, when the driving duty of the inverter circuit 3 changes from 59% to 56% in a state in which a difference between the coil current and the output current of the inverter circuit 3 becomes less than a predetermined value, in response to "pot-displacement", both the output current of the inverter circuit and the coil current may increase gradually. In other words, in response to "pot-displacement", when the driving duty of the inverter circuit 3 is reduced in a state in which the difference between the coil current and the output current of the inverter circuit 3 is less than the predetermined value, the difference between the coil current and the output current of the inverter circuit 3 may be maintained at less than or equal to a predetermined value.

Referring to FIG. 4C, when the driving duty of the inverter circuit 3 changes from 59% to 56% in a state in which a difference between the coil current and the output current of the inverter circuit 3 becomes less than a predetermined value, in response to "pot-floating", both the output current of the inverter circuit 3 may decrease, but the coil current may increase. In other words, in response to "pot-floating", when the driving duty of the inverter circuit 3 is reduced in a state in which the difference between the coil current and the output current of the inverter circuit 3 is less than the predetermined value, the difference between the coil current and the output current of the inverter circuit 3 may become greater than the predetermined value.

The determiner 82 may identify that "pot-floating" or "pot-displacement" occurs in response to a condition (1) in which an output current INV [A] of the inverter circuit 3 exceeds a predetermined value a [A] or in response to a condition (2) in which a difference ICOIL-IINV between an coil current ICOIL [A] and an output current IINV [A] of the inverter circuit 3 is less than a predetermined value b.

In response to "pot-floating" or "pot-displacement" being identified by the determiner 82, the inverter circuit controller 81 lowers the driving frequency and driving duty of the inverter circuit 3. Thereafter, after a predetermined time elapses after lowering the driving frequency and driving duty of the inverter circuit 3, the determiner 82 may identify that "pot-displacement" occurs in response to the condition (1) in which the output current INV [A] of the inverter circuit 3 exceeds the predetermined value a [A] or in response to the condition (2) in which the difference ICOIL-IINV between the coil current ICOIL [A] and the output current IINV [A] of the inverter circuit 3 is less than the predetermined value b.

As an example of a method of lowering the driving frequency and driving duty of the inverter circuit 3, the driving duty of the inverter circuit 3 may be lowered by a [%] for each carrier cycle up to a driving duty of predetermined thermal power. In addition, the driving frequency may be lowered by X1 [Hz] for each carrier cycle.

Further, in response to the conditions (1) and (2) being not satisfied after the predetermined time elapses after lowering the driving frequency and driving duty of the inverter circuit 3, the determiner 82 identifies that "pot-floating" or "pot-displacement" occurs.

In response to the output current IINV [A] of the inverter circuit 3 exceeding the predetermined value a [A], the determiner 82 may identify that "pot-floating" or "pot-displacement" occurs. In response to the output current IINV [A] of the inverter circuit 3 exceeding the predetermined value a [A], the inverter circuit controller 81 lowers the driving frequency and driving duty of the inverter circuit 3. In response to the output current IINV [A] of the inverter circuit 3 still exceeding the predetermined value a [A], the determiner 82 may identify that "pot-displacement" occurs. In response to the output current IINV [A] of the inverter circuit 3 still being less than the predetermined value a [A], the determiner 82 may identify that "pot-floating" occurs.

In response to that the difference ICOIL-IINV between the coil current ICOIL [A] and the output current IINV [A] of the inverter circuit 3 is less than the predetermined value b, the determiner 82 may identify that "pot-floating" or "pot-displacement" occurs. In response to that the difference ICOIL-IINV between the coil current ICOIL [A] and the output current IINV [A] of the inverter circuit 3 is less than the predetermined value b, the inverter circuit controller 81 lowers the driving frequency and driving duty of the inverter circuit 3. Thereafter, in response to that the difference ICOIL-IINV between the coil current ICOIL [A] and the output current IINV [A] of the inverter circuit 3 is still less than the predetermined value b, the determiner 82 may identify that "pot-displacement" occurs. In response to that the difference ICOIL-IINV between the coil current ICOIL [A] and the output current IINV [A] of the inverter circuit 3 is still equal to or greater than the predetermined value b, the determiner 82 may identify that "pot-floating" occurs.

In response to "pot-floating" identified by the determiner 82, the inverter circuit controller 81 performs heating with new target thermal power lower than the target thermal power before the pot-floating occurs (refer to FIG. 3). In response to "pot-displacement" identified by the determiner 82, the inverter circuit controller 81 stops heating.

Because the induction heating cooking device 100 includes an inverter current detector configured to detect an output current of the inverter circuit and a coil current detector configured to detect the coil current flowing through the heating coil, the induction heating cooking device 100 may determine the pot-floating or the pot-displacement while suppressing the inverter current.

Because, in response to the pot-floating, heating is performed with the new target thermal power lower than the target thermal power before the pot-floating occurs, the control device may continue heating with the electric power that does not cause the pot-floating without stopping the heating operation. In addition, in response to the pot-displacement, the control device may stop the heating.

The disclosure is not limited to the above embodiment.

For example, the determination of the pot-floating and the pot-displacement by the determiner may be performed according to the following operations.

That is, the determiner 82 determines that the pot-floating or the pot-displacement occurs in response to a case (1) in which the inverter current exceeds a predetermined value or in response to a case (2) in which the coil current is less than a predetermined value.

In response to determining that the pot-floating or the pot-displacement occurs, the determiner 82 lowers the driving frequency and/or the driving duty of the inverter circuit, and after a predetermined time elapses, the determiner 82 identifies that the pot-displacement occurs in response to the inverter current exceeding the predetermined value or in response to the coil current being less than the predetermined value. If not, the determiner 82 identifies that the pot-floating occurs.

Figure 5:
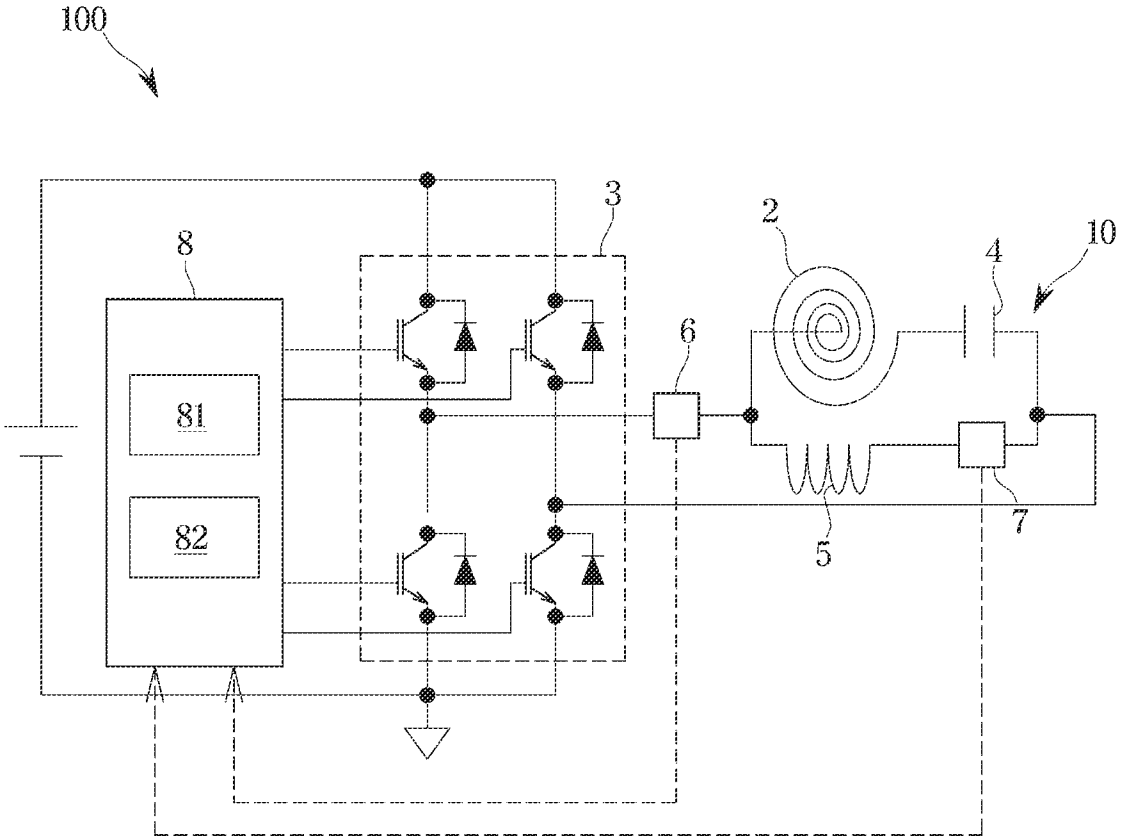
FIG. 5 is a schematic diagram illustrating an overall configuration of an induction heating cooking device according to an embodiment of the disclosure.

FIG. 5 is a schematic diagram illustrating an overall configuration of an induction heating cooking device according to another embodiment of the disclosure.

Figure 6:
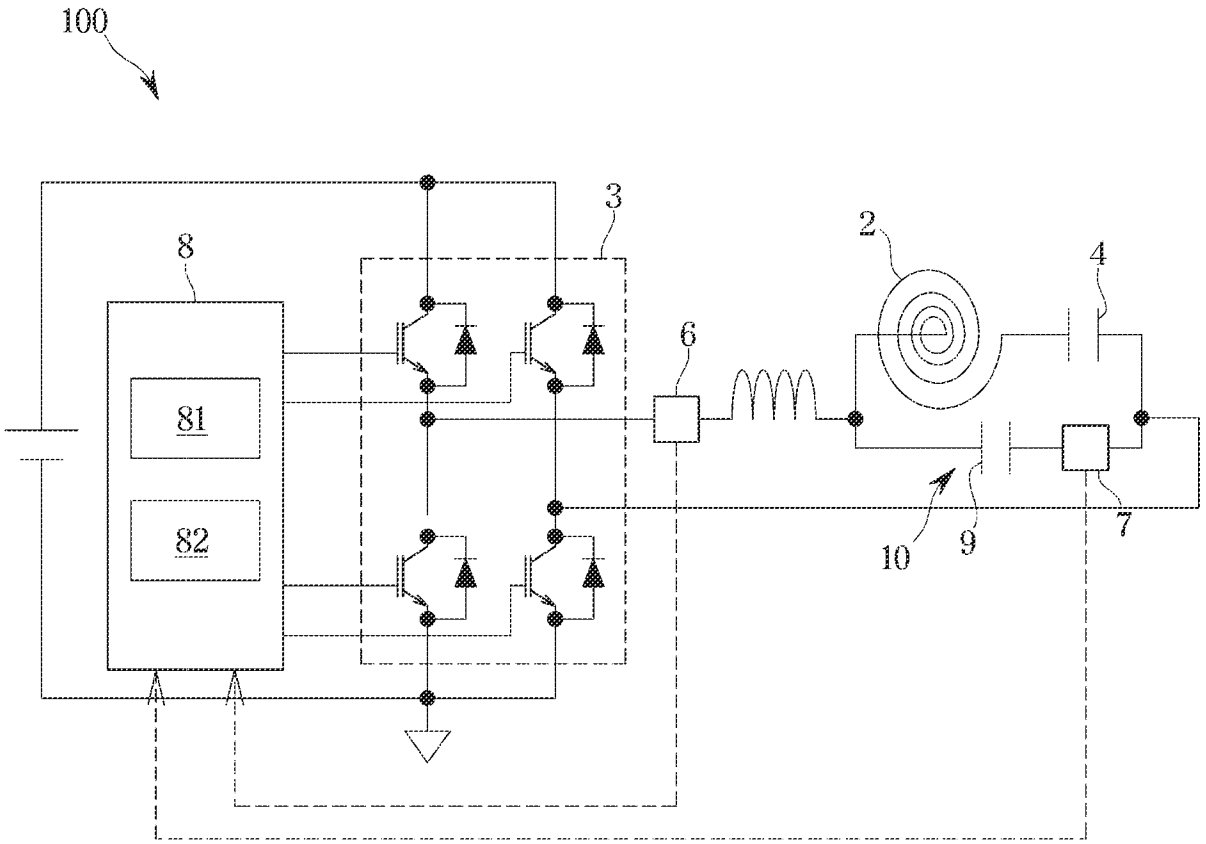
FIG. 6 is a schematic diagram illustrating an overall configuration of an induction heating cooking device according to an embodiment of the disclosure.

FIG. 6 is a schematic diagram illustrating an overall configuration of an induction heating cooking device according to another embodiment of the disclosure.

Figure 7A:
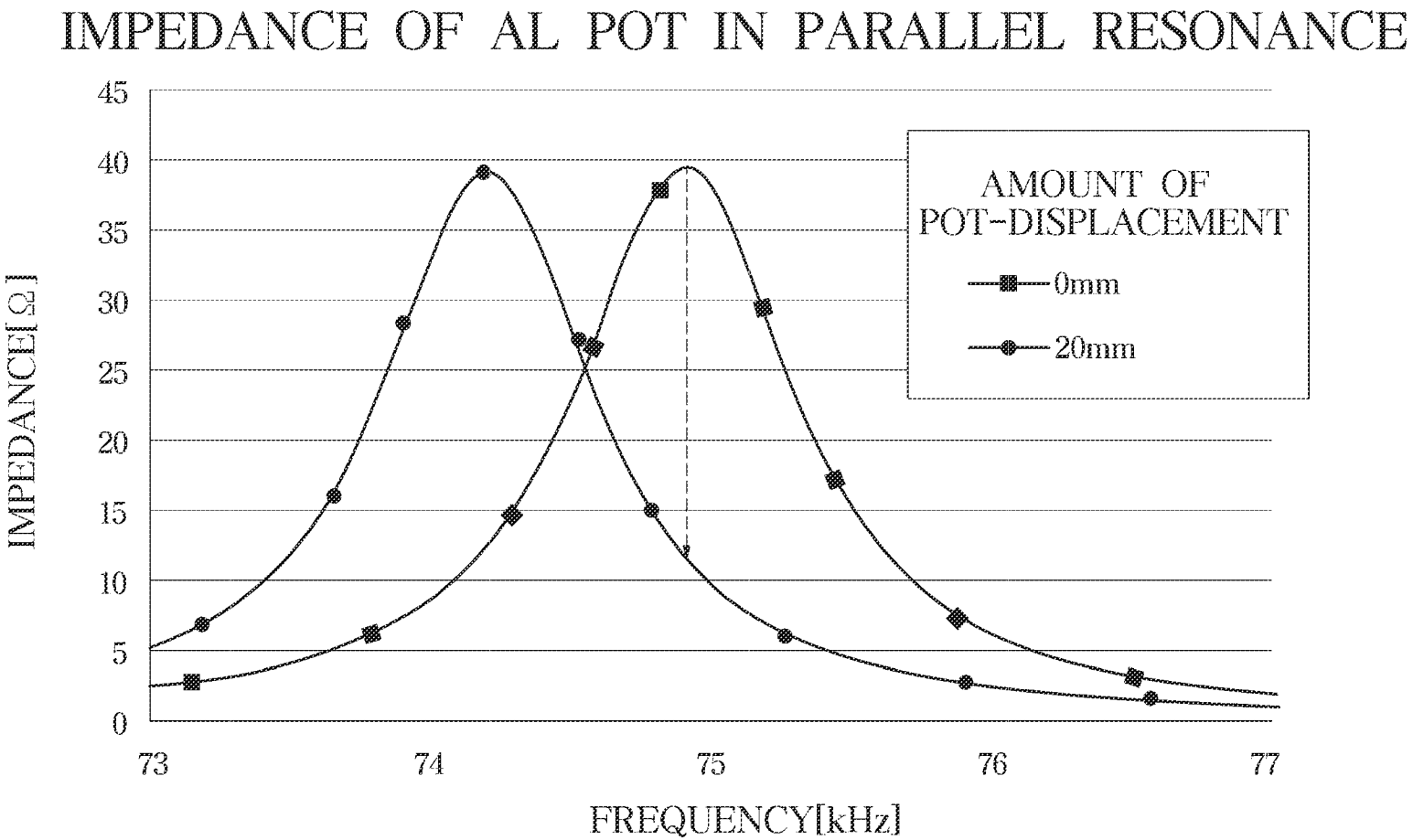
FIG. 7A is a diagram illustrating a change in impedance in response to the pot-displacement in an LC parallel resonance according to an embodiment of the disclosure.

FIG. 7A is a diagram illustrating a change in impedance in response to the pot-displacement in an LC parallel resonance according to an embodiment of the disclosure.

Figure 7B:
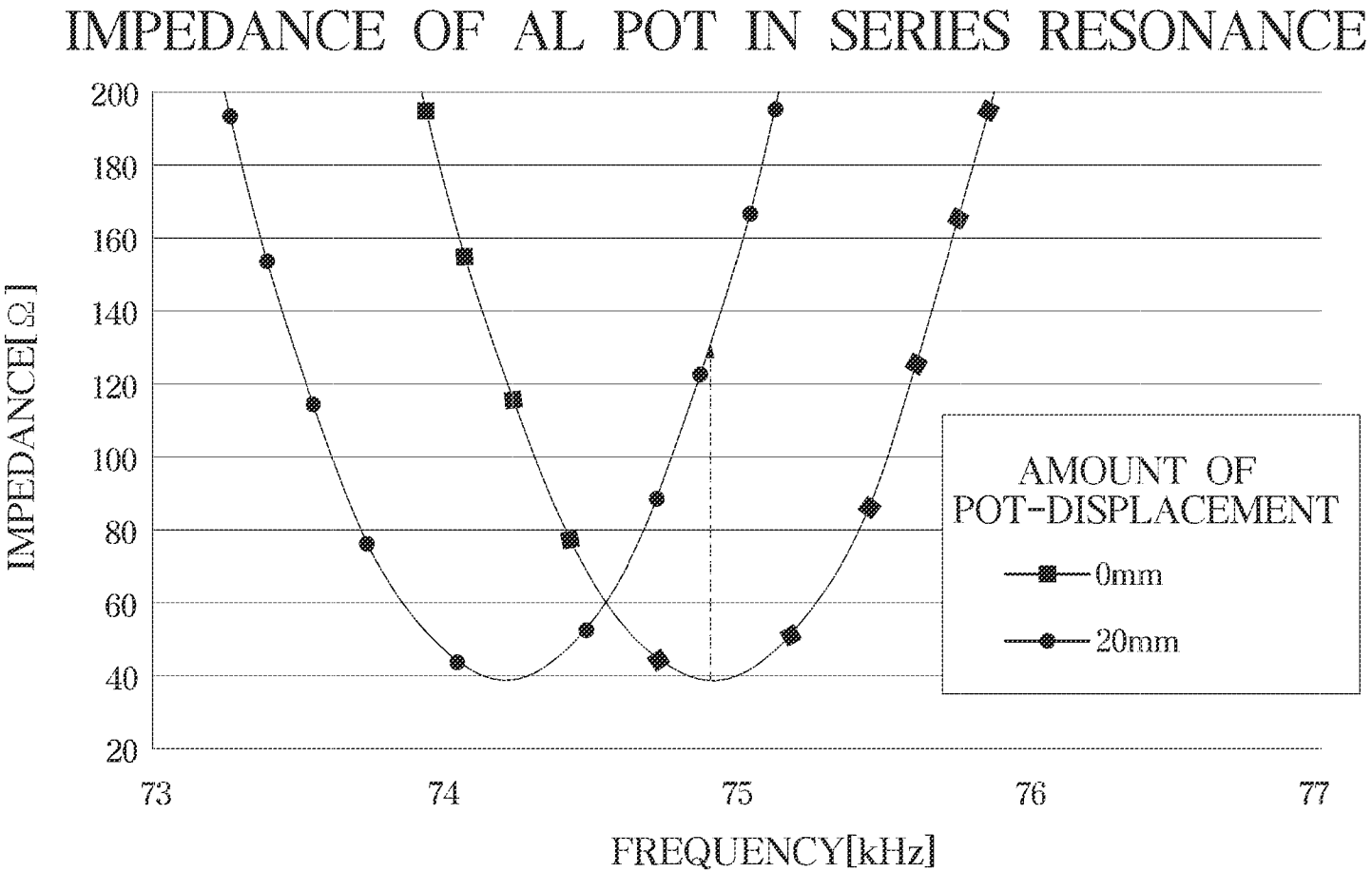
FIG. 7B is a diagram illustrating a change in impedance in response to the pot-displacement in an LC series resonance according to an embodiment of the disclosure.

FIG. 7B is a diagram illustrating a change in impedance in response to the pot-displacement in an LC series resonance according to an embodiment of the disclosure.

In addition, a resonance coil element 5 of an LC parallel resonant circuit may be provided separately from a heating coil 2 referring to FIG. 5. Further, referring to FIG. 6, by providing a resonant capacitor 9 in parallel to a heating coil 2, an LC parallel resonant circuit may be composed of the heating coil 2 and the resonant capacitor 9.

According to the disclosure, an induction heating cooking device includes a heating coil configured to heat an object to be heated using an induction heating method, an inverter circuit configured to supply a high frequency current to the heating coil, an LC parallel resonant circuit including a resonant capacitor connected in series with the coil and a resonance coil element connected in parallel to the resonant capacitor, an inverter current detector configured to detect an output current of the inverter circuit, and a coil current detector configured to detect a coil current flowing the heating coil.

Because the induction heating cooking device includes the inverter current detector configured to detect an output current of the inverter circuit and the coil current detector configured to detect the coil current flowing through the heating coil, the induction heating cooking device may determine pot-floating or pot-displacement while suppressing the inverter current.

Particularly, it is appropriate that the induction heating cooking device further includes a control device configured to determine whether the pot-floating or the pot-displacement occurs by using an output current detected by the inverter current detector and a coil current detected by the coil current detector.

Particularly, as an embodiment for determining the pot-floating or the pot-displacement, it is appropriate that the control device determines that the pot-floating or the pot-displacement occurs in response to an inverter current exceeding a predetermined value or in response to that a difference between a coil current and an inverter current is less than a predetermined value. A reason why the pot-floating or the pot-displacement is determined by the two conditions is because determination criteria are different depending on the thermal power (electric power).

More particularly, it is appropriate that the control device lowers the driving frequency and/or the driving duty of the inverter circuit in response to determining that the pot-floating or the pot-displacement occurs, and after a predetermined time elapses, the control device determines that the pot-displacement occurs in response to the inverter current exceeding a predetermined value or in response to identifying that a difference between the coil current and the inverter current is less than a predetermined value, and if not, the control device determines that the pot-floating occurs.

In addition, it is appropriate that the control device determines that the pot-floating or the pot-displacement occurs in response to the inverter current exceeding a predetermined value or in response to the coil current being less than a predetermined value.

More particularly, it is appropriate that the control device lowers the driving frequency and/or the driving duty of the inverter circuit in response to determining that the pot-floating or the pot-displacement occurs, and after a predetermined time elapses, the control device determines that the pot-displacement occurs in response to the inverter current exceeding the predetermined value or in response to the coil current being less than the predetermined value, and if not, the control device determines that the pot-floating occurs.

In response to determining that the pot-floating occurs, in order to maintain heating with the electric power that does not cause the pot-floating without stopping the heating operation, it is appropriate that the control device heats the pot with new target thermal power, which is lower than the target thermal power before the pot-floating occurs.

As is apparent from the above description, it is possible to determine pot-floating or pot-displacement while suppressing an inverter current.

Various embodiments of the disclosure have been described above. In the various embodiments described above, some components may be implemented as a "module". Here, the term 'module' means, but is not limited to, a software and/or hardware component, such as a Field Programmable Gate Array (FPGA) or Application Specific Integrated. Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more central processing units (CPUs) in a device.

With that being said, and in addition to the above described various embodiments, embodiments can thus be implemented through computer readable code/instructions in/on a medium, e.g., a computer readable medium, to control at least one processing element to implement any above described embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While various embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An induction heating apparatus comprising:

a heating coil;

an inverter;

a current sensor disposed in an LC parallel resonant circuit and being configured to measure a driving current supplied from the inverter to the heating coil; and a controller configured to:

based on a user input, provide a first drive signal to the inverter to allow the driving current to follow a first target current corresponding to a first power set by the user input, based on the driving current exceeding a predetermined reference current, reduce a driving duty of the first drive signal, based on the driving current being less than or equal to the predetermined reference current after reducing the driving duty of the first drive signal, provide a second drive signal to the inverter to allow the driving current to follow a second target current corresponding to a second power less than the first power set by the user input, and based on the driving current exceeding the predetermined reference current after reducing the driving duty of the first drive signal, stop an operation of the inverter.

2. The induction heating apparatus of claim 1, wherein the controller is further configured to:

based on the driving current being less than or equal to the predetermined reference current after reducing the driving duty of the first drive signal, identify pot-floating in which a pot floats with respect to the heating coil.

3. The induction heating apparatus of claim 1, wherein the controller is further configured to:

based on the driving current exceeding the predetermined reference current after reducing the driving duty of the first drive signal, identify pot-displacement in which a pot is out of position with respect to the heating coil.

4. The induction heating apparatus of claim 1, wherein the controller is further configured to:

based on the driving current exceeding the predetermined reference current, reduce the driving duty of the first driving signal by a predetermined amount of reduction in each carrier cycle.

5. The induction heating apparatus of claim 1, wherein the controller is further configured to:

based on the driving current exceeding the predetermined reference current, reduce a driving frequency of the first driving signal by a predetermined amount of reduction in each carrier cycle.

6. The induction heating apparatus of claim 1, wherein the LC parallel resonant circuit comprises a resonant capacitor connected in parallel with a resonance coil element comprising at least a portion of the heating coil.

7. The induction heating apparatus of claim 1, further comprising:

a resonant capacitor connected in series with the heating coil; and a resonant inductor connected in parallel with the heating coil and the resonant capacitor.

8. The induction heating apparatus of claim 1, further comprising:

a first resonant capacitor connected in series with the heating coil;

a second resonant capacitor connected in parallel with the heating coil and the first resonant capacitor; and a resonant inductor connected in series with the heating coil, the first resonant capacitor, and the second resonant capacitor.

9. An induction heating apparatus comprising:

a heating coil;

an inverter;

a first current sensor disposed on an output side of the inverter and being configured to measure an output current output from the inverter;

a second current sensor disposed in an LC parallel resonant circuit and being configured to measure an input current input to the heating coil; and a controller configured to:

based on a user input, provide a first drive signal to the inverter to allow at least one of the output current or the input current to follow a first target current corresponding to a first power set by the user input, based on a difference between the output current and the input current being less than or equal to a predetermined reference value, reduce a driving duty of the first drive signal, based on the difference between the output current and the input current exceeding the predetermined reference value, provide a second drive signal to the inverter to allow the at least one of the output current or the input current to follow a second target current corresponding to a second power less than the first power set by the user input, and based on the difference between the output current and the input current being less than or equal to the predetermined reference value after reducing the driving duty of the first drive signal, stop an operation of the inverter.

10. The induction heating apparatus of claim 9, wherein the controller is further configured to:

based on the difference between the output current and the input current exceeding the predetermined reference value after reducing the driving duty of the first drive signal, identify pot-floating in which a pot floats with respect to the heating coil.

11. The induction heating apparatus of claim 9, wherein the controller is further configured to:

based on the difference between the output current and the input current being less than or equal to the predetermined reference value after reducing the driving duty of the first drive signal, identify pot-displacement in which a pot is out of position with respect to the heating coil.

12. The induction heating apparatus of claim 9, wherein the controller is further configured to:

based on the difference between the output current and the input current being less than or equal to the predetermined reference value, reduce a driving frequency of the first driving signal.

13. The induction heating apparatus of claim 9, wherein the LC parallel resonant circuit comprises a resonant capacitor connected in series to the heating coil, wherein a resonance coil element is composed of a part of the heating coil, and wherein the resonance coil element is connected in parallel to the resonant capacitor.

* * * * *